US010857588B2

(12) United States Patent
Wendeler-Goeggelmann

(10) Patent No.: US 10,857,588 B2
(45) Date of Patent: Dec. 8, 2020

(54) BENDING DEVICE AND METHOD FOR PRODUCING A WIRE MESH

(71) Applicant: Geobrugg AG, Romanshorn (CH)

(72) Inventor: Corinna Wendeler-Goeggelmann, Herisau (CH)

(73) Assignee: Geobrugg AG, Romanshorn (CH)

( * ) Notice: Subject to any disclaimer, the term of this patent is extended or adjusted under 35 U.S.C. 154(b) by 0 days.

(21) Appl. No.: 16/477,357

(22) PCT Filed: Jan. 16, 2018

(86) PCT No.: PCT/EP2018/050967
§ 371 (c)(1),
(2) Date: Jul. 11, 2019

(87) PCT Pub. No.: WO2018/137966
PCT Pub. Date: Aug. 2, 2018

(65) Prior Publication Data

US 2019/0381558 A1 Dec. 19, 2019

(30) Foreign Application Priority Data

Jan. 30, 2017 (DE) ..... 10 2017 101 751

(51) Int. Cl.
*B21F 27/04* (2006.01)

(52) U.S. Cl.
CPC ..... *B21F 27/04* (2013.01)

(58) Field of Classification Search
CPC ..... B21F 27/00; B21F 27/02; B21F 27/04; B21F 27/005
See application file for complete search history.

(56) References Cited

U.S. PATENT DOCUMENTS 1,852,396 A 4/1932 Bergandi
2,106,454 A 1/1938 Frost et al.
(Continued)

FOREIGN PATENT DOCUMENTS

CA 2 752 023 A1 4/2012
CH 703 929 B1 4/2012
(Continued)

OTHER PUBLICATIONS

Search Report dated May 23, 2017 issued in corresponding DE patent application No. 10 2017 101 751.8 (and English translation).
(Continued)

*Primary Examiner* — Teresa M Ektiert
(74) *Attorney, Agent, or Firm* — Posz Law Group, PLC

(57) ABSTRACT

A bending device for producing a wire netting, in particular a safety net, includes a plurality of helices, which are braided with one another, and of which at least one helix is made from at least one single wire, a wire bundle, a wire strand, a wire rope, and/or another longitudinal element having at least one wire that comprises high-tensile steel, having at least one bending unit which, for producing a helix blank having at least two curved legs and having at least one bend point that connects the curved legs by a bending of the longitudinal element, has at least one guide worm and at least one braiding knife that is rotatable relative to the guide worm about a rotation axis, and having a braiding unit which is configured for braiding the helix blank into a pre-netting of the wire netting, and the bending device has a straightening unit which is configured for an at least partial straightening of the curved legs.

9 Claims, 7 Drawing Sheets

(56) References Cited

U.S. PATENT DOCUMENTS

| | | | | |
|---|---|---|---|---|
| 3,512,760 | A * | 5/1970 | Rohrbacher | B21F 27/04 140/92.3 |
| 4,572,249 | A | 2/1986 | Lange | |
| 6,279,858 | B1 | 8/2001 | Eicher | |
| 2015/0041599 | A1 | 2/2015 | Wartmann | |
| 2018/0214929 | A1 | 8/2018 | Wendeler-Goeggelmann | |
| 2019/0321877 | A1 | 10/2019 | Wendeler-Goeggelmann | |
| 2019/0330810 | A1 | 10/2019 | Wendeler-Goeggelmann | |

FOREIGN PATENT DOCUMENTS

| | | | |
|---|---|---|---|
| CH | 706 178 | A2 | 8/2013 |
| CL | 2014002127 | A1 | 11/2014 |
| CL | 2018000245 | A1 | 6/2018 |
| CL | 2019001909 | A1 | 9/2019 |
| CL | 2019001912 | A1 | 12/2019 |
| CN | 104308049 | A | 1/2015 |
| CN | 205816651 | U | 12/2016 |
| DE | 629 040 | C | 4/1936 |
| DE | 2 327 005 | A1 | 12/1974 |
| DE | 32 46 381 | C1 | 12/1983 |
| DE | 27 45 334 | C2 | 4/1987 |
| DE | 42 11 737 | A1 | 10/1993 |
| FR | 2620639 | A1 | 3/1989 |
| GB | 1 475 190 | A | 6/1977 |
| JP | S57-1534 | A | 1/1982 |
| WO | 99/43894 | A1 | 9/1999 |

OTHER PUBLICATIONS

Office Action dated Aug. 29, 2017 issued in corresponding DE patent application No. 10 2017 101 751.8 (and English translation).

Office Action dated Mar. 2, 2018 issued in corresponding DE patent application No. 10 2017 101 751.8 (and English translation).

Notice of Allowance dated Mar. 27, 2018 issued in corresponding DE patent application No. 10 2017 101 751.8 (and English translation).

International Search Report dated Apr. 4, 2018 issued in corresponding International Patent Application No. PCT/EP2018/050967.

International Preliminary Report on Patentability dated Jul. 30, 2019 issued in corresponding International Patent Application No. PCT/EP2018/050967.

Office Action dated Dec. 2, 2019 issued in corresponding CN patent application No. 201880009225.X (and English translation).

Office Action dated May 9, 2020 issued in corresponding CN patent application No. 201880009225.X (and English translation).

"Straightening Principle and Straightening Machine." Cui Fu, Metallurgical Industry Press, Jul. 2002. Version 1.

Office Action and Search Report dated May 14, 2020 issued in corresponding CL patent application No. 201902014 (and English translation).

First Examination Report dated Aug. 18, 2020 issued in corresponding IN patent application No. 201917028347 (and English translation).

* cited by examiner

BENDING DEVICE AND METHOD FOR PRODUCING A WIRE MESH

CROSS REFERENCE TO RELATED APPLICATIONS

This application is a U.S. national stage application of PCT/EP2018/050967 filed on Jan. 16, 2018, which is based on German Patent Application No. 10 2017 101 751.8 filed on Jan. 30, 2017, the contents of which are incorporated herein by reference.

PRIOR ART

The invention relates to a bending device for producing a wire netting and to a method for producing a wire netting.

Wire nettings from high-tensile steel wire which are made on braiding machines using braiding knives are known from the prior art. Wire nettings of this type, by virtue of the high flexural rigidity of high-tensile steel wires, have bulging loops which are formed by curved leg portions.

The object of the invention lies in particular in providing a bending device of the generic type having advantageous properties with a view to manufacturing wire nettings with a load-bearing capability. According to the invention, the object is achieved by means of the features of the patent claims, while advantageous embodiments and refinements of the invention emerge from the claims.

Advantages of the Invention

The invention proceeds from a bending device for producing a wire netting, in particular a safety net, which has a plurality of helices which are braided with one another and of which at least one helix is made from at least one wire bundle, a wire strand, a wire rope, and/or another longitudinal element having at least one wire that comprises steel, having at least one bending unit which, for producing a helix blank having at least two curved legs and having at least one bend point that connects the curved legs by a bending of the longitudinal element, has at least one guide worm and at least one braiding knife that is rotatable relative to the guide worm about a rotation axis, and having a braiding unit which is configured for braiding the helix blank into a pre-netting of the wire netting.

It is proposed that the bending device has a straightening unit which is configured for an at least partial straightening of the curved legs.

The bending device according to the invention advantageously enables simple and/or cost-effective and/or reliable and/or precise production of a wire netting with a load-bearing capability. Precise manufacturing can be achieved in particular with a view to a geometry of a wire netting. A high throughput rate can furthermore be achieved in manufacturing. Moreover, a high flexibility with a view to implementable geometries of a wire netting and/or the loops of the latter can be achieved. The manufacturing of a wire netting having a high tensile strength transversely to the helices of the wire netting is advantageously enabled. Moreover, manufacturing can advantageously be adapted to a characteristic of a wire used.

In particular, the helix is manufactured from a longitudinal element, specifically an individual wire, a wire bundle, a wire strand, a wire rope and/or another longitudinal element which comprises at least the wire. In this context, a "wire" is to be understood in particular to mean a body which is elongate and/or thin and/or at least mechanically bendable and/or flexible. The wire advantageously has, along its longitudinal direction, an at least substantially constant, in particular circular or elliptical cross section. The wire is particularly advantageously embodied as a round wire. It is however also conceivable for the wire to be implemented at least section-wise, or entirely, as a flat wire, a square wire, a polygonal wire and/or a profiled wire. For example, the wire may be implemented at least partially or else entirely from metal, in particular a metal alloy, and/or organic and/or inorganic plastic and/or a composite material and/or an inorganic non-metallic material and/or a ceramic material. It is for example conceivable that the wire is embodied as a polymer wire or a synthetic wire. In particular, the wire may be embodied as a composite wire, for example as a metal-organic composite wire and/or a metal-inorganic composite wire and/or a metal-polymer composite wire and/or a metal-metal composite wire or the like. In particular, it is conceivable that the wire comprises at least two different materials, which are in particular disposed relative to one another in accordance with a composite geometry and/or are at least partially mixed with one another. The wire is advantageously realized as a metal wire, in particular as a steel wire, in particular as a high-grade steel wire. If the helix has a plurality of wires, these are preferably identical. It is however also conceivable for the helix to have a plurality of wires which differ in particular with regard to their material and/or their diameter and/or their cross section. Preferably, the wire has an in particular corrosion-resistant coating and/or casing such as for example a zinc coating and/or an aluminum-zinc coating and/or a plastics coating and/or a PET coating and/or a metal oxide coating and/or a ceramic coating or the like.

The transverse extent of the helix is advantageously greater, in particular significantly greater, than a diameter of the wire and/or than a diameter of the longitudinal element from which the helix is manufactured. The transverse extent is advantageously smaller, in particular significantly smaller, than a length of the leg. Depending on the use and in particular depending on the desired load-bearing capacity and/or depending on the desired spring characteristics of the wire netting, in particular in a frontal direction, the transverse extent may for example be two times or three times or five times or ten times or 20 times greater than the diameter of the longitudinal element, wherein values lying in between, or lower values or higher values, are also conceivable. Likewise, depending on the use, the wire may have a diameter of for example approximately 1 mm, approximately 2 mm, approximately 3 mm, approximately 4 mm, approximately 5 mm, approximately 6 mm, approximately 7 mm or even more or less, or else a diameter of an intermediate value. Greater, in particular significantly greater, diameters are furthermore conceivable if the longitudinal element comprises a plurality of components, in particular a plurality of wires, such as for example in the case of a wire rope or a strand or a wire bundle or the like.

A "plane of main extent" of an object is to be understood in particular to mean a plane which is parallel to a largest side surface of a smallest imaginary cuboid which just completely encloses the object and which in particular runs through the central point of the cuboid.

In particular, the wire netting is implemented as an embankment safeguard, as a safety fence, as a catchment fence, as a stone impact protection net, as a barrier fence, as a fish farming net, as a predator protection net, as an enclosure fence, as a tunnel safeguard, as a landslide protection means, as a motor sport protection fence, as a road fence, as an avalanche safeguard or the like. The wire netting is in particular of planar form. The wire netting is advantageously of regular construction and/or, in at least one direction, periodic construction. The wire netting can preferably be rolled up and/or unrolled, in particular about an axis which runs parallel to the direction of main extent of the helix. In particular, a roll of rolled-up wire netting can be unrolled in a direction that is perpendicular to the direction of main extent of the helix. The wire netting advantageously has a plurality of loops which are in particular of identical form. The helices particularly advantageously form the loops.

The helix is preferably implemented so as to be spiral. In particular, the helix is implemented as a flattened spiral. It is advantageous for the helix, along the profile thereof, to have an at least substantially consistent or a consistent diameter and/or cross section. The helix and/or the longitudinal element and/or the wire preferably have/has a circular cross section. It is particularly preferable for the helix to have a plurality of legs, which are advantageously embodied so as to be at least substantially identical or identical. The helix is preferably implemented of a single, in particular interruption-free, wire. The helix is preferably implemented from a single longitudinal element, in particular only from the longitudinal element, for example from the wire or a strand or a wire rope or a wire bundle or the like.

In this context, "at least substantially identical" objects are in particular to mean objects that are constructed such that they can each perform a common function and differ in terms of their construction, aside from manufacturing tolerances, at most by individual elements which are of no significance for the common function. "At least substantially identical" is preferably to mean identical, apart from manufacturing tolerances and/or in the context of possibilities in terms of manufacturing technology, wherein identical objects are in particular also be understood to be mutually symmetrical objects. An "at least substantially constant value" is to be understood in this context in particular to mean a value which varies by at most 20%, advantageously by at most 15%, particularly advantageously by at most 10%, preferably by at most 5%, and particularly preferably by at most 2%. By an object having an "at least substantially constant cross section" is in particular to be understood, in this context, that for any first cross section of the object along at least one direction and for any second cross section of the object along the direction, a minimum area value of a differential area that is formed when the cross sections are placed one on top of the other amounts to at most 20%, advantageously at most 10% and particularly advantageously at most 5% of the area value of the larger one of the two cross sections.

The helix in particular has a longitudinal direction. The longitudinal direction of the helix is preferably disposed so as to be at least substantially parallel or parallel to a direction of main extent of the helix. The helix preferably has a longitudinal axis which runs parallel to the longitudinal direction of the helix. The plane of main extent of the helix is preferably disposed at least substantially parallel to the plane of main extent of the wire netting, at least in a state of planar configuration and/or a planar unrolled state of the wire netting, which may in particular differ from an installed state of the wire netting. Here, a "direction of main extent" of an object is in particular to mean a direction which runs parallel to a longest edge of a smallest imaginary cuboid just still completely enclosing the object. Here, "at least substantially parallel" is in particular to mean an orientation of a direction relative to a reference direction, in particular in a plane, wherein the direction has a deviation of in particular less than 8°, advantageously less than 5° and particularly advantageously less than 2° with respect to the reference direction.

The wire netting preferably has a plurality or a multiplicity of helices which are in particular embodied so as to be at least substantially identical or in particular identical. It is also conceivable for the wire netting to be implemented from a plurality of different helices. It is in particular conceivable that the wire netting has a plurality or a multiplicity of first helices, and a plurality or a multiplicity of second helices that are embodied so as to differ from the first helices and that are in particular disposed in an alternating manner. The helices are advantageously connected to one another. In particular, adjacent helices are disposed such that their longitudinal directions run parallel. It is preferable if in each case one helix is braided and/or twisted into in each case two helices adjacent thereto. In particular, the wire netting can be produced by virtue of a helix being twisted into a pre-netting, a further helix being twisted so as to be incorporated into this incorporated twisted helix, yet another helix being twisted so as to be incorporated into this further incorporated twisted helix, and so forth. In particular, the helices of the wire netting have the same direction of rotation. It is advantageous for in each case two helices to be knotted together, in particular in each case at a first of their ends and/or in each case at a second of their ends, situated opposite the first ends.

The wire is in particular at least partially made from high-tensile steel, in particular completely made from high-tensile steel, apart from a coating. The high-tensile steel may for example be spring steel and/or steel suitable for wire ropes. In particular, the wire has a tensile strength of at least 800 N $mm^{-2}$, advantageously of at least 1000 N $mm^{-2}$, particularly advantageously of at least 1200 N $mm^{-2}$, preferably of at least 1400 N $mm^{-2}$ and particularly preferably of at least 1600 N $mm^{-2}$, in particular a tensile strength of approximately 1770 N $mm^{-2}$ or of approximately 1960 N $mm^{-2}$. It is also conceivable for the wire to have an even higher tensile strength, for example a tensile strength of at least 2000 N $mm^{-2}$, or of at least 2200 N $mm^{-2}$, or else of at least 2400 N $mm^{-2}$. In this way, a high load-bearing capacity, in particular a high tensile strength and/or a high stiffness transversely with respect to the netting, can be achieved.

The braiding knife is preferably arranged at least partially in the guide worm. The guide worm preferably forms at least one guide path and/or a guide link for the helix blank. The bending unit is advantageously configured for a simultaneous bending of two wires which are wound around the braiding knife and/or bent about the braiding knife so as to in particular run in a mutually parallel manner. The bending unit is in particular configured for simultaneously making two helices and for braiding said helices into one another when bending. The guide worm preferably has a further guide path for a further helix blank.

The legs of the helix blank are preferably curved so as to emanate from a plane that is parallel to the plane of main extent of the helix. The legs of the helix blank are particularly preferably convexly curved. The helix blank, by virtue of the curved legs, is in particular implemented to form a bulge. The helix blank in a region of the bend point is advantageously bent by less than 180°. In particular the bend point, as well as in each case half a curved leg that adjoins the bend point, conjointly implement a bend of 180°.

The pre-netting advantageously comprises a plurality of helices which are braided with one another and/or helix blanks. The braiding unit is in particular configured for a braiding, in particular a twisting, of the helix blank along the longitudinal direction thereof into the pre-netting. The helix blank, when it has been braided and/or twisted into the pre-netting, is advantageously cut off so as to correspond to a width of the pre-netting and/or a width of the wire netting, and is in particular knotted to at least one advantageously neighboring helix, advantageously at opposite ends of the respective helices. The helix blank, after being braided and after being cut to length, preferably forms a helix of the wire netting.

An "at least partial straightening" of an object is in particular, in this context, to be understood as a deformation which at least approximates a profile of the object so as to form a linear profile, in particular in comparison to a non-deformed state of the object. The straightening unit is advantageously configured for a straightening of the curved legs. The straightening unit is particularly advantageously configured for providing the legs with a straight profile. After the straightening, the legs that adjoin the bend point run in particular in parallel planes. The straightening unit is preferably configured for increasing a bending angle of the bend point. The straightening unit is particularly preferably configured for providing the bend point with a bending angle of 180°. The helix blank in the region of the bend point after the straightening is advantageously bent by 180°. The straightening unit is in particular configured for a bending of the curved legs so as to be straight.

In an advantageous implementation of the invention it is proposed that the straightening unit is configured for compressing the helix blank in a pressing direction that is perpendicular to the rotation axis and in particular perpendicular to the longitudinal direction of the helix blank. The straightening unit is advantageously configured for a bending of the curved legs toward the rotation axis. The straightening unit is preferably configured for a bending of pre-bulged regions of the curved legs toward one another. On account thereof, curvatures which arise when bending a helix can advantageously be subsequently reduced and/or straightened.

In a particularly advantageous implementation of the invention it is proposed that the compressing includes an over-pressing and/or over-bending the curved legs. A spacing between the legs, in particular perpendicular to the rotation axis, in the over-bending and/or over-pressing and/or in an over-pressed and/or over-bent state of the legs, is in particular smaller than in a completed state of the respective helix and/or of the wire netting. The curved legs are advantageously over-pressed and/or over-bent by at least a few millimeters, wherein an over-pressing distance and/or an over-bending distance depend/depends in particular on a flexural rigidity and/or characteristic of the wire, and/or on a geometry of the helix blank. An over-pressing distance and/or an over-bending distance of the straightening unit is preferably adjustable and/or adaptable to a geometry of the helix blank and/or to a characteristic of the wire. The straightening unit is preferably configured for over-bending and/or over-pressing the legs so far that the legs upon completed bending and upon a subsequent partial spring-back have a straight profile. This advantageously allows a precise straightening of a back-springing wire in a region of legs of a helix of a wire netting.

It is moreover proposed that the straightening unit is supported so as to be rotatable around the rotation axis. The bending device preferably has a common drive unit for the braiding knife and a rotation of the straightening unit. The straightening unit in the bending of the wire and/or in the straightening advantageously rotates in the same direction as the braiding knife. In this way, a high manufacturing rate can advantageously be achieved. Furthermore, decelerating and accelerating moved parts in a running operation can advantageously be largely dispensed with on account thereof.

In a further implementation of the invention it is proposed that a rotation of the braiding knife and a rotation of the straightening unit are synchronized. A movement of the straightening unit is advantageously in particular mechanically coupled to a movement of the braiding knife. It is also conceivable that the bending unit has an open-loop control unit and/or a closed-loop control unit which synchronize/synchronizes a rotation of the straightening unit with the rotation of the braiding knife. A position of the straightening unit, in particular the center of gravity of the latter, relative to the braiding knife is preferably constant during the rotation of the braiding knife and during the rotation of the straightening unit. A position of the straightening unit, in particular the center of gravity of the latter, relative to the helix blank is particularly preferably non-rotated. The helix blank during the production thereof, along the longitudinal direction thereof, moves in particular relative to the straightening unit, wherein an orientation of the helix blank relative to the straightening unit is in particular constant. On account thereof, a straightening unit can advantageously be conjointly guided in a precise manner. Furthermore, over-bending curved legs can be performed in a controlled and/or reliable manner on account thereof.

It is moreover proposed that the straightening unit has at least one pressing element which is movable perpendicularly to the longitudinal direction of the helix blank. The pressing element is in particular supported so as to be movable perpendicularly to the rotation axis. The pressing element is advantageously configured for pressing the helix blank, in particular at least one curved leg. Particularly advantageously, the pressing element for the straightening is movable toward the rotation axis and/or after the straightening is movable away from the rotation axis. A movement of the pressing element, in particular toward the rotation axis and/or away from the rotation axis, is preferably synchronized with the rotation of the straightening unit and/or with the rotation of the braiding knife, and is advantageously coupled to said rotation of the straightening unit and/or to said rotation of the braiding knife. A pressing distance, in particular the length thereof, across which the pressing element in the straightening moves relative to the rotation axis is preferably adjustable. A degree of the over-pressing and/or of the over-bending is preferably adjustable by means of adjusting the pressing distance. The pressing distance defines in particular the over-bending distance and/or the over-pressing distance. The pressing element advantageously has a pressing surface which in the straightening is pushed against at least one curved leg. The pressing surface can be flat or curved, in particular pre-bulged. It is in particular conceivable that the pressing surface is bulged in such a manner that different regions of a curved leg are bent and/or pressed, in particular over-bent and/or over-pressed, to a different extent. The straightening unit preferably has at least one further pressing element which is in particular disposed so as to be opposite the pressing element. The pressing element is preferably movable relative to the further pressing element. The further pressing element is particularly preferably movable perpendicularly to the rotation axis. The pressing element and the further pressing element are in particular movable toward one another. The further pressing element is preferably implemented at least substantially identically to the pressing element. The further pressing element is particularly advantageously realized mirror-symmetrically to the pressing element, in particular in relation to a plane in which the rotation axis runs. It is also conceivable that the further pressing element is embodied as a counter-holding element, wherein the pressing element in the straightening pushes the helix blank in particular at least partially against the further pressing element. A high mechanical reliability can advantageously be achieved on account thereof. Straightening can furthermore be carried out rapidly and reliably on account thereof.

In a preferred implementation of the invention it is proposed that the pressing element is disposed in an outlet region of the bending unit and/or of the braiding knife. The pressing element is in particular disposed at a spacing of at most 1 m, advantageously of at most 0.5 m, and particularly advantageously of at most 0.3 m, from the bending unit and/or from the braiding knife. The straightening is preferably performed before the helix blank is braided into the pre-netting. The straightening unit is in particular disposed between the bending unit and the braiding unit. The helix blank, after the bending thereof in the bending unit, preferably runs through the straightening unit and subsequently the braiding unit. The straightening unit is preferably configured for simultaneously straightening only part of the helix blank, in particular only some legs and bend points of the helix, advantageously at most or exactly ten neighboring legs, particularly preferably at most or exactly eight neighboring legs, preferably at most or exactly six neighboring legs, preferably at most or exactly four neighboring legs, and advantageously at most or exactly two neighboring legs, as well as in particular in each case corresponding bend points that connect the legs and/or neighbor the legs. A compact construction mode of a bending device can advantageously be achieved on account thereof. Furthermore, uniform straightening can be achieved in the running operation on account thereof.

Alternatively or additionally, it is proposed that the pressing element is disposed in a proximity of the braiding unit. The straightening unit can in particular be configured for a straightening of the helix blank and/or the legs thereof after the helix blank has been braided into the pre-netting. The pressing element can advantageously be configured for simultaneously pressing a plurality of in particular neighboring helix blanks. It is conceivable that the straightening unit is disposed so as to be immovable and/or locationally fixed relative to the braiding unit. It is in particular conceivable that the pre-netting in the straightening is pressed section-wise between the pressing element and the further pressing element. In this case in particular, the pressing element can be supported so as to be movable perpendicularly to the pre-netting. A high flexibility in terms of an independent adaptation of different operating steps can advantageously be achieved on account thereof.

Precise manufacturing and/or advantageous properties in terms of fixing a longitudinal element that is to be processed are achievable if the pressing element has at least one guide element. The guide element is in particular configured for at least partially and/or section-wise guiding and/or fixing the helix blank, in particular during advancing and/or during pressing. The guide element can be embodied, for example, as a groove or a rib. It is also conceivable that the guide element is embodied as a bolt. The pressing element can in particular have a plurality of in particular different guide elements, for example a plurality of bolts and/or pins and/or grooves and/or ribs.

It is moreover proposed that a length of the pressing element defines a maximum length of the helix. The pressing element can in particular be configured for simultaneously straightening the entire helix. The pressing element can advantageously extend so as to be parallel to the helix blank in the braided state of the latter. It is conceivable that a width of the pressing element exceeds a width of the pre-netting and/or a length of the helix blank. A direction of main extent of the pressing element can preferably be disposed so as to be parallel to a width direction of the pre-netting and/or to the longitudinal direction of the helix blank in the braided state of the latter. High efficiency can advantageously be achieved on account thereof.

It is moreover proposed that the bending unit and/or the straightening unit are/is configured for a processing of a wire having a tensile strength of at least 800 N $mm^{-2}$. The bending unit is in particular configured for a processing of the wire. Manufacturing of a wire netting which is tensile-resistant and/or with a load-bearing capability can advantageously be enabled on account thereof.

In principle, it is conceivable that the straightening unit is configured for heating and/or cooling the helix blank, in particular during the straightening. For example, it is conceivable that the pressing element and/or the further pressing element are/is implemented in such a way that it is heatable to allow the straightening to be realized at a rather high temperature. It is also conceivable that the helix blank is directly or indirectly cooled in the straightening.

The invention further relates to a method for producing a wire netting, in particular a safety net, which has a plurality of helices which are braided with one another and of which at least one helix is produced from at least one single wire, a wire bundle, a wire strand, a wire rope, and/or another longitudinal element having at least one wire that comprises high-tensile steel and is in particular produced at least by means of the bending device, wherein a helix blank having at least two curved legs and having at least one bend point that connects the legs is made by bending the longitudinal element, and wherein the helix blank is braided into a pre-netting of the wire netting.

It is proposed that the curved legs are at least partially straightened.

The method according to the invention advantageously enables simple and/or cost-effective and/or reliable and/or precise production of a wire netting with a load-bearing capability. A geometry of a wire netting can in particular be precisely manufactured. A high throughput rate can furthermore be achieved in manufacturing. Moreover, a high flexibility with a view to implementable geometries of a wire netting and/or the loops of the latter can be achieved. The manufacturing of a wire netting having a high tensile strength transversely to the helices of the wire netting is advantageously enabled. Moreover, manufacturing can advantageously be adapted to a characteristic of wire used.

The curved legs are preferably straightened. The method is in particular configured for producing the wire netting. The method advantageously comprises at least one method step which is configured for generating and/or implementing at least one of the features of the wire netting. The term "configured" is in particular to mean specifically programmed, designed and/or equipped. The fact that an object is configured for a specific function is in particular to mean that the object fulfils and/or executes this particular function in at least one use state and/or operating state. The statement that a method is "configured" to fulfil a purpose is in particular to mean that the method comprises at least one method step which is specifically directed to the purpose and/or that the method is intentionally directed to the purpose and/or that the method serves for fulfilling the purpose and is at least partially optimized for such fulfillment. The statement that a method step is "configured" for a purpose is in particular to mean that the method step is specifically directed to the purpose and/or that the method step is intentionally directed to the purpose and/or that the method step serves for fulfilling the purpose and is at least partially optimized for such fulfillment.

In an advantageous implementation of the invention it is proposed that the helix blank, before it is braided into the pre-netting, and in particular after the bending of the helix blank, is at least section-wise pressed for a straightening of the curved legs. Some of the legs of the helix blank are in particular in each case simultaneously straightened, advantageously directly after bending the helix blank, in particular by means of the bending unit. The straightening of the curved legs of the helix blank is advantageously performed so as to be synchronized with the bending of the helix blank. A high precision in straightening can advantageously be achieved on account thereof.

It is alternatively proposed that the helix blank, when it has been braided into the pre-netting, is pressed at least section-wise for a straightening of the curved legs. Advantageously, the entire helix blank is simultaneously pressed and/or straightened. A low pressing rate at a simultaneously high throughput rate can advantageously be used on account thereof.

It is moreover proposed that the curved legs for the straightening are over-bent and/or over-pressed. The curved legs are in particular over-bent and/or over-pressed in such a manner that the legs, after spring-back of the longitudinal element, in particular of the wire, follow a straight profile, and/or that the bend point after the spring-back of the wire describes a bend of 180°, and/or that the straightened legs run in parallel planes. On account thereof, straightening can advantageously be adapted to a characteristic of a wire used.

In order for advantageous properties in terms of a load-bearing capacity and/or a cost-effective and/or rapid and/or reliable production capability to be achieved, a wire netting, which is produced by a method according to the invention and/or by a bending of a bending device according to the invention, is proposed.

The bending device according to the invention and the method according to the invention herein are not intended to be limited to the applications and embodiments described above. In particular, the bending device according to the invention and the method according to the invention for fulfilling a functional mode described herein can have a number of individual elements and/or components and/or units and/or method steps which differs from a number stated herein.

DRAWINGS

Further advantages can be gathered from the following description of the drawings. Two exemplary embodiments of the invention are illustrated in the drawings. The drawings, the description and the claims contain numerous features in combination. A person skilled in the art will expediently also consider the features individually and combine them to form appropriate further combinations.

DESCRIPTION OF THE EXEMPLARY EMBODIMENTS

Figure 1:
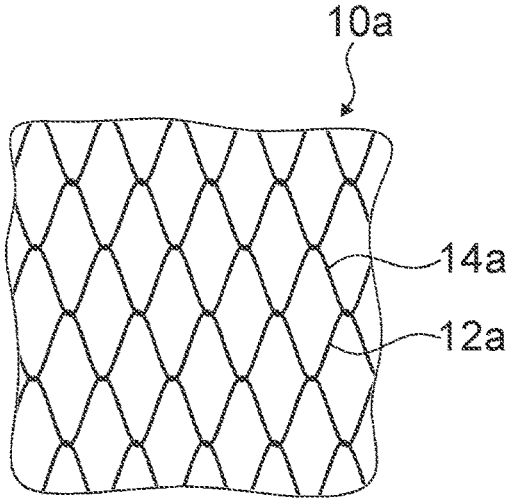
FIG. 1 shows a part of a wire netting in a schematic front view.

FIG. 1 shows a part of a wire netting 10*a* in a schematic front view. The wire netting 10*a* is embodied as a safety net. The wire netting 10*a* that is shown may for example be used as an embankment safeguard, avalanche safeguard net, catchment fence or the like. The wire netting 10*a* has a plurality of helices 12*a*, 14*a* which are braided with one another, in particular a helix 12*a* and a further helix 14*a*. In the present case, the wire netting 10*a* has a plurality of identically implemented helices 12*a*, 14*a* which are twisted into one another and realize the wire netting 10*a*.

Figure 2:
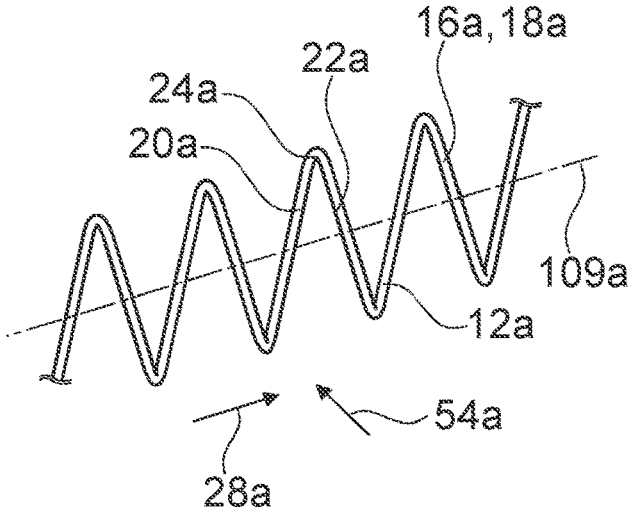
FIG. 2 shows a part of a helix of the wire netting in a perspective illustration.
Figure 3:
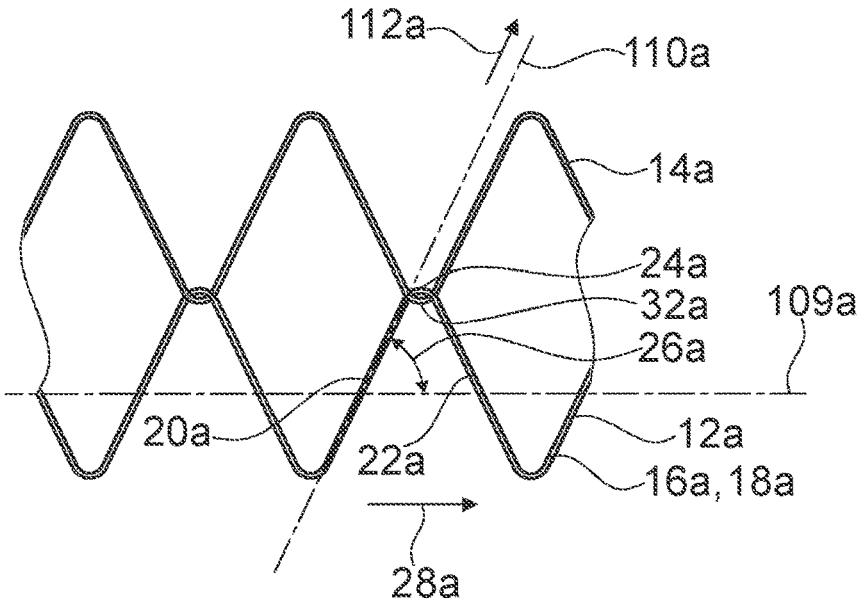
FIG. 3 shows a further part of the wire netting in a schematic front view.

FIG. 2 shows a portion of the helix 12*a* of the wire netting 10*a* in a perspective illustration. FIG. 3 shows a further part of the wire netting 10*a* in a schematic front view. The helix 12*a* is manufactured from a longitudinal element 16*a* having a wire 18*a*. In the present case, the longitudinal element is embodied as a single wire. In the present case, the longitudinal element 16*a* is the wire 18*a*. The wire 18*a* has a corrosive-resistant coating. However, it is also conceivable for a longitudinal element to comprise a plurality of wires and/or other elements. For example, a longitudinal element may be realized as a wire rope, a wire bundle, a wire strand, or the like. The properties of the wire 18*a* will be described hereunder. However, said properties can be applied in a corresponding manner to other longitudinal elements. For example, a strand or a wire bundle or another longitudinal element can be bent so as to form a helix in an analogous manner to the shown wire 18*a*, and helices from longitudinal elements of this type can be connected in a corresponding manner so as to form a wire netting.

The wire 18*a* is bent to form the helix 12*a*. The helix 12*a* is embodied in a one-part implementation. The helix 12*a* is manufactured from a single wire piece. In the present case, the wire 18*a* has a diameter of 3 mm. The wire 18*a* is at least partially manufactured from high-tensile steel. The wire 18*a* is embodied as a high-tensile steel wire. The wire 18*a* has a tensile strength of at least 800 N $mm^{-2}$. In the present case, the wire 18*a* has a tensile strength of approximately 1770 N $mm^{-2}$. As mentioned above, other tensile strengths are however self-evidently also conceivable, in particular also tensile strengths of greater than 2200 N $mm^{-2}$. In particular, it is conceivable for a wire to be manufactured from ultra-high-tensile steel. It is furthermore conceivable for a wire to have some other diameter, such as for example less than 1 mm, or approximately 1 mm, or approximately 2 mm, or approximately 4 mm, or approximately 5 mm, or approximately 6 mm, or an even greater diameter. As mentioned above, it is conceivable that a wire comprises different materials and is in particular realized as a composite wire.

The helix 12*a* and the further helix 14*a* are embodied identically. The helix 12*a* is therefore described in more detail in an exemplary manner hereunder. However, it is also conceivable that a wire netting comprises at least one first helix and at least one second helix which is implemented differently than the first helix.

The helix 12*a* has a first leg 20*a*, a second leg 22*a* and a bend point 24*a* that connects the first leg 20*a* and the second leg 22*a*. In the present case, the helix 12*a* has a plurality of first legs 20*a*, a plurality of second legs 22*a* and a plurality of bend points 24*a*, which, for the sake of clarity, are not all denoted by reference signs. Furthermore, in the present case, the first legs 20*a* are of at least substantially identical design with respect to one another. Furthermore, in the present case, the second legs 22*a* are of at least substantially identical design with respect to one another. Furthermore, in the present case, the bend points 24*a* are of at least substantially identical design with respect to one another. Therefore, by way of example, the first leg 20*a*, the second leg 22*a* and the bend point 24*a* will be described in more detail below. It is self-evidently conceivable for a wire netting to have different first legs and/or different second legs and/or different bend points.

The helix 12*a* has a longitudinal direction 28*a*. The helix 12*a* has a longitudinal axis 109*a* which runs parallel to the longitudinal direction 28*a*. The longitudinal direction 28*a* corresponds to a direction of main extent of the helix 12*a*. In a frontal view 54*a* perpendicular to a plane of main extent of the helix 12*a*, the first leg 20*a* runs with a first inclination angle 26*a* with respect to the longitudinal direction 28*a* of the helix 12*a*. In particular, the frontal view is a view in frontal direction 54*a*. The first leg 20*a* has a longitudinal axis 110*a*. The longitudinal axis 110*a* of the first leg 20*a* runs parallel to a direction of main extent 112*a* of the first leg 20*a*. FIG. 3 illustrates the helix 12*a* in the frontal view. The longitudinal axis 109*a* of the helix 12*a* and the longitudinal axis 110*a* of the first leg 20*a* enclose the first inclination angle 26*a*. In the present case, the first leg 20*a* has a length of approximately 65 mm. In the present case, the second leg 22*a* has a length of approximately 65 mm. The first inclination angle 26*a* in the present case is approximately 60°. However, other values for a first inclination angle are also conceivable, for example 30°, 45°, 75°, or smaller or larger values, or values therebetween.

FIG. 4 shows a portion of the helix 12*a* which comprises the first leg 20*a*, the second leg 22*a* and the bend point 24*a*, in different views. FIG. 4*a* shows a view in the longitudinal direction 28*a* of the helix 12*a*. FIG. 4*b* shows the first leg 20*a*, the second leg 22*a* and the bend point 24*a* in a transverse view perpendicular to the longitudinal direction 28*a* of the helix 12*a* and in the plane of main extent of the helix 12*a*. FIG. 4*c* shows a view in the frontal direction 54*a*. FIG. 4*d* shows a perspective view. In the transverse view, the bend point 24*a* runs, at least section-wise, with a second inclination angle 30*a*, which differs from the first inclination angle 26*a*, with respect to the longitudinal direction 28*a* of the helix 12*a*. In the transverse view, the bend point 24*a* has a longitudinal axis 114*a*. The longitudinal axis 114*a* of the bend point 24*a* and the longitudinal axis 109*a* of the helix 12*a* enclose the second inclination angle 30*a*.

The second inclination angle 30*a* deviates from the first inclination angle 26*a* by at least 5°. The second inclination angle 30*a* has a value between 25° and 65°. Furthermore, the first inclination angle 26*a* is greater than 45°. In the present case, the first inclination angle 26*a* amounts to approximately 60°. Furthermore, in the present case, the second inclination angle 30*a* amounts to approximately 45°. The second inclination angle 30*a* is smaller than the first inclination angle 26*a*.

It is, of course, also conceivable that a first inclination angle and a second inclination angle are identical. For example, a first inclination angle and a second inclination angle can both be in each case at least substantially or exactly 45°. Other values are also conceivable, for example 30° or 35° or 40° or 50° or 55° or 60° or 65° or 70°, or further values, in particular even larger or even smaller values. A person skilled in the art will choose values for a first inclination angle and a second inclination angle in a suitable manner, in particular so as to depend on a list of requirements pertaining to a corresponding wire netting.

In the transverse view, the bend point 24*a*, at least section-wise, follows an at least approximately straight profile. In the present case, in the transverse view, a major part of the bend point 24*a* follows the straight profile.

In the transverse view, the helix 12*a*, at least section-wise, follows a stepped profile. The stepped profile is obliquely stepped.

Figure 4A:
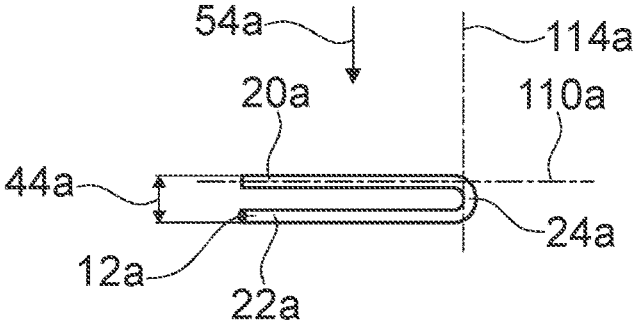
FIG. 4 shows two legs and a bend point of the helix in different views.
Figure 4B:
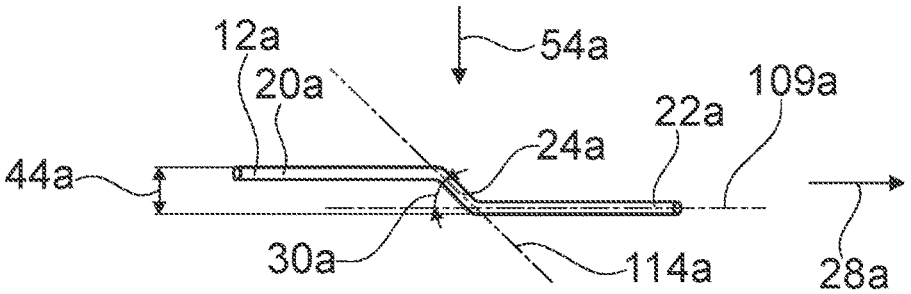
Figure 4C:
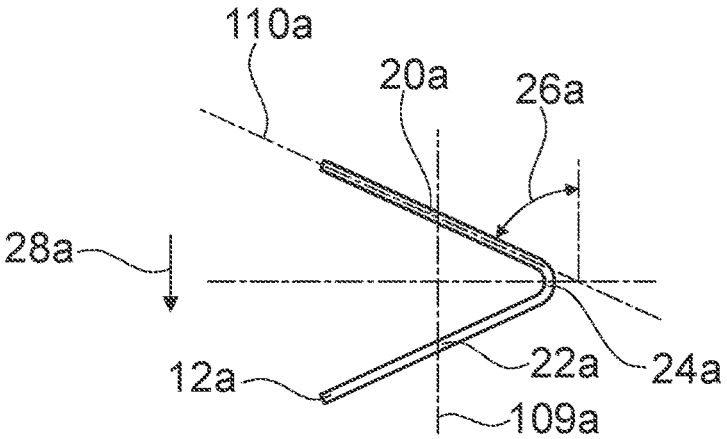
Figure 4D:
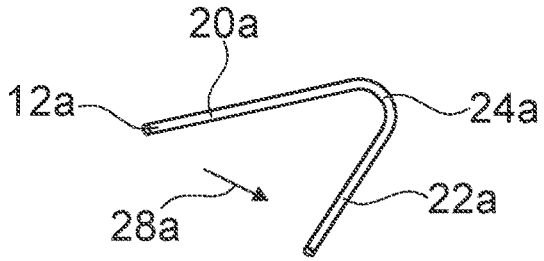
Figure 5A:
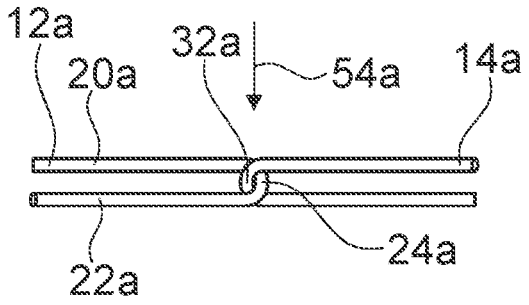
FIG. 5 shows two interconnected bend points of two helices in different views.
Figure 5B:
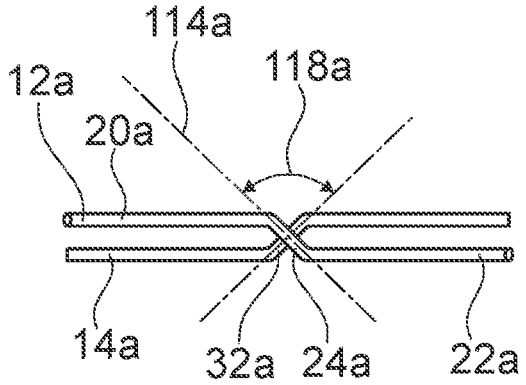
Figure 5C:
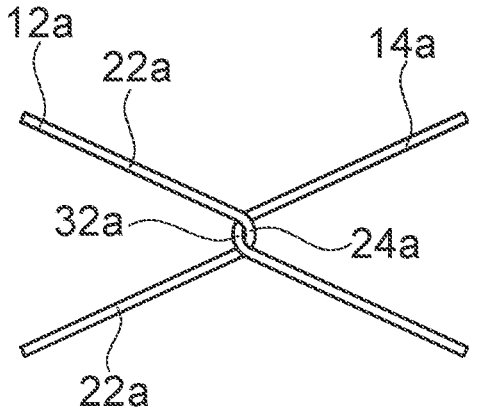
Figure 5D:
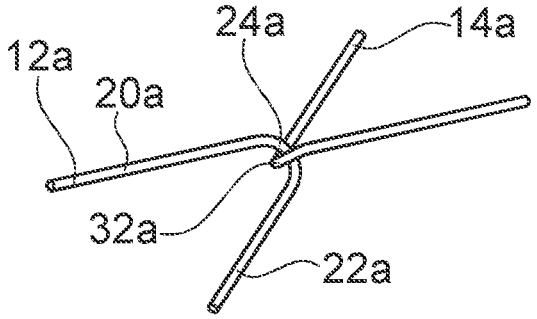

The first leg 20*a*, at least section-wise, follows a straight profile. In the present case, the first leg 20*a* follows a straight profile. The second leg 22*a*, at least section-wise, follows a straight profile. In the present case, the second leg 22*a* follows a straight profile. The first leg 20*a* and/or the second leg 22*a* are free from a curvature and/or a bend and/or a kink. The bend point 24*a* comprises a profile which, in a longitudinal view parallel to the longitudinal direction 28*a* of the helix 12*a*, describes a bend through 180°. FIG. 4*a* illustrates the helix 12*a* in the longitudinal view.

The first leg 20*a* runs, at least section-wise, in particular entirely, in a first plane, and the second leg 22*a* runs, at least section-wise, in particular entirely, in a second plane which is parallel to the first plane. In the longitudinal view, the first leg 20*a* runs parallel to the second leg 22*a*.

The further helix 14*a* has a further bend point 32*a*. The bend point 24*a* and the further bend point 32*a* are connected. The bend point 24*a* and the further bend point 32*a* form a linking point of the helix 12*a* and of the further helix 14*a*.

FIG. 5 shows a part of the wire netting 10*a*, which comprises the bend point 24*a* and the further bend point 32*a*, in different views. FIG. 5*a* shows a view in the longitudinal direction 28*a* of the helix 12*a*. FIG. 5*b* shows the part of the wire netting 10*a* in a transverse view perpendicular to the longitudinal direction 28*a* of the helix 12*a* in the plane of main extent of the helix 12*a*. FIG. 5*c* shows a view in the frontal direction 54*a*. FIG. 5*d* shows a perspective view.

The helix 12*a* and the further helix 14*a* cross one another at least substantially perpendicularly in a region of the further bend point 32*a*. In the transverse view, the bend point 24*a* and the further bend point 32*a* enclose an intersection angle 118*a*. The intersection angle 118*a* is dependent on the second inclination angle 30*a* and on a correspondingly defined further second inclination angle of the further helix 14*a*. In the present case, the intersection angle 118*a* amounts to 90°.

For other first inclination angles, too, a second inclination angle of 45° is advantageously selected, such that correspondingly designed helices cross one another perpendicularly at connecting points, and said connecting points advantageously have a high mechanical load-bearing capacity. Of course, intersection angles that differ from 90° are also conceivable, for example having a value of 45° or 60° or 120° or 145°, or a larger or smaller value, or a value therebetween. A person skilled in the art will choose an intersection angle in a suitable manner, in particular so as to depend on a list of requirements pertaining to a corresponding wire netting.

Figure 6:
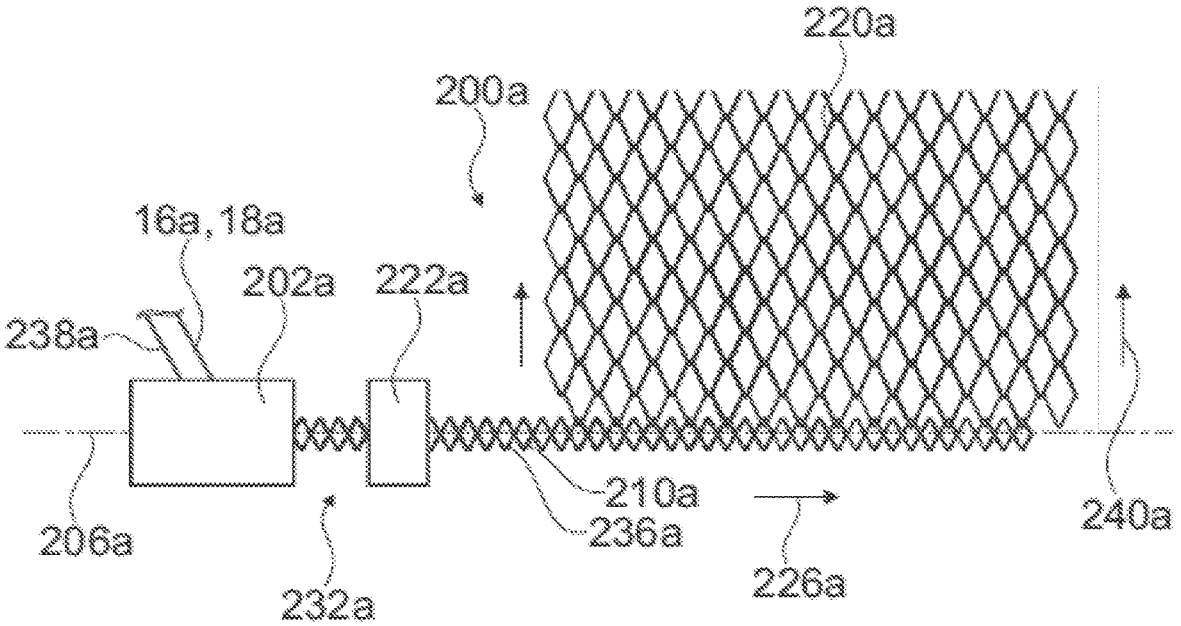
FIG. 6 shows a bending device in a schematic illustration.
Figure 7:
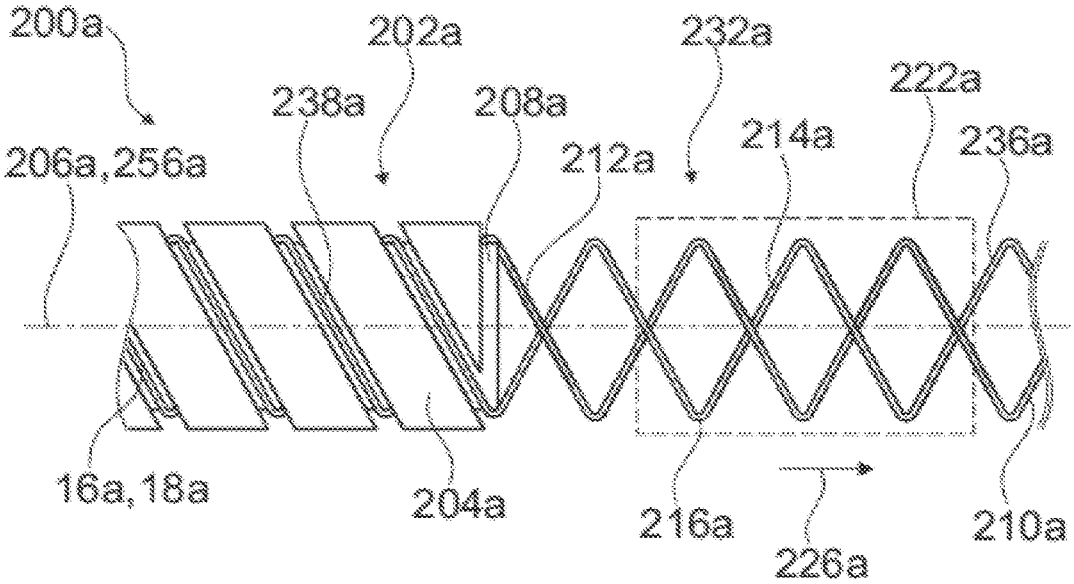
FIG. 7 shows a part of the bending device in a schematic lateral view.
Figure 8:
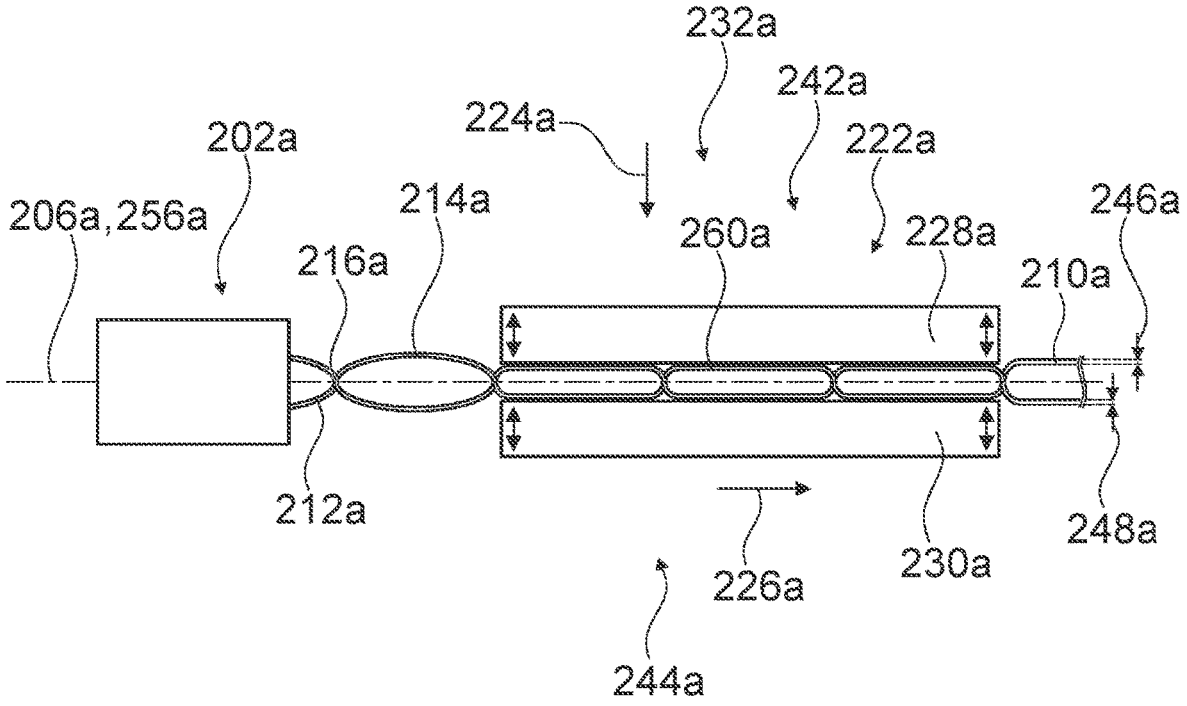
FIG. 8 shows the part of the bending device in a schematic plan view.

FIG. 6 shows a bending device 200*a* for producing the wire netting 10*a*. FIG. 7 shows a part of the bending device 200*a* in a schematic lateral view. FIG. 8 shows the part of the bending device 200*a* in a schematic plan view. The bending device 200*a* is configured for producing the wire netting 10*a*. When a longitudinal element that is not embodied as a single wire, such as for example a strand and/or a wire bundle or the like, is used instead of the wire 18*a*, the said longitudinal element is processed and/or guided and/or bent and/or aligned, etc. in a manner analogous to the wire 18*a*. However, the case in which the longitudinal element 16*a* is embodied as the wire 18*a* is described hereunder.

The bending device 200*a* has a bending unit 202*a* for producing a helix blank 210*a*. The bending unit 202*a* comprises a guide worm 204*a* and a braiding knife 208*a* which is rotatable relative to the guide worm 204*a* about a rotation axis 206*a*. The bending unit 202*a* is configured for producing the helix blank 210*a*. The bending unit 202*a* is configured for producing the helix blank 210*a* by a bending of the wire 18*a*. The helix blank 210*a* comprises two curved legs 212*a*, 214*a*, as well as a bend point 216*a* that connects the curved legs 212*a*, 214*a*. The helix blank 210*a* comprises a plurality of curved legs 212*a*, 214*a* which for reasons of clarity are not all provided with reference signs. The wire 18*a* in the bending is bent about the braiding knife 208*a* so as to form the helix blank 210*a*. The helix blank 210*a* in the bending about the braiding knife 208*a* is made so as to have curved legs 212*a*, 214*a*. The legs 212*a*, 214*a* in the bending about the braiding knife 208*a* are provided with a curvature, in particular by virtue of the high tensile strength of the wire 18*a*. The wire 18*a* in a rotation of the braiding knife 208*a* around the rotation axis 206*a* is bent so as to form the helix blank 210*a*.

The bending unit 202*a* in the present case is configured for simultaneously making a further helix blank 236*a* in addition to the helix blank 210*a*, said further helix blank 236*a* being in particular at least substantially identical to the helix blank 210*a*. The further helix blank 236*a* is made from a further wire 238*a* which is in particular embodied at least substantially identically to the wire 18*a*. The wire 18*a* and the further wire 238*a* are wound about the braiding knife 208*a* so as to be mutually spaced apart. The wire 18*a* and the further wire 238*a* are simultaneously bent in the rotation of the braiding knife 208*a* around the rotation axis 206*a*.

The bending device 200*a* comprises a braiding unit which is configured for braiding the helix blank 210*a* into a pre-netting 220*a* of the wire netting 10*a*. The braiding unit in the present case is configured for producing the wire netting 10*a*. The helix blank 210*a* after being braided is cut to length so as to correspond to a width of the pre-netting 220*a*, or of the wire netting 10*a*, respectively. Furthermore, the helix blank 210*a* at the ends thereof is knotted to neighboring helices and/or helix blanks, and thereafter forms a helix of the pre-netting 220*a*. After the helix blank 210*a* has been braided, advancing of the pre-netting 220*a* in a feed direction 240*a* is performed. A next helix blank can subsequently be braided into the pre-netting 220*a* that thereupon is extended. After an envisaged number of helices have been added to the pre-netting 220*a*, the latter forms the wire netting 10*a*. Of course, intervening post-processing steps such as, for example, coating and/or varnishing and/or adding further braided netting elements and/or adding edge elements or the like, are conceivable.

The bending device 200*a* has a straightening unit 222*a* which is configured for at least partially straightening the curved legs 212*a*, 214*a*. The straightening unit 222*a* is configured for straightening the curved legs 212*a*, 214*a*. The straightening unit 222*a* is configured for a bending and/or post-processing and/or straightening of the curved legs 212*a*, 214*a* as well as the bend point 216*a* of the helix blank 210*a* in such a manner that said legs 212*a*, 214*a* and said bend point 216*a* are shaped so as to correspond to the geometry of the legs 20*a*, 22*a* and of the bend point 24*a* of the helix 12*a*. A braided netting from non-straightened helix blanks would have bulged loops as well as a front and rear side with multiple bulges and/or curves, whereas the wire netting 10*a* from straightened helix blanks 210*a* has legs 20*a*, 22*a* running in parallel planes and correspondingly a parallel front and rear side.

The straightening unit 222*a* is configured for compressing the helix blank 210*a* in a pressing direction 224*a* perpendicular to the rotation axis 206*a*. The pressing direction 224*a* runs perpendicularly to a longitudinal direction 226*a* of the helix blank 210*a*. The straightening unit 222*a* in the present case is configured for pressing the helix blank 210*a* from two opposite sides 242*a*, 244*a*. In the pressing, a transverse extent 44*a* of the helix blank 210*a*, perpendicular to the longitudinal direction 226*a* of the helix blank 210*a*, is reduced in size. An operating state of the bending device 200*a* shortly before straightening the curved legs 212*a*, 214*a* is illustrated in FIG. 8. In a next operating state, adjoining the operating state illustrated, the curved legs 212*a*, 214*a* are introduced into the straightening unit 222*a* and straightened therein in that the helix blank 210*a* is compressed.

The compressing of the helix blank 210*a* includes over-pressing and/or over-bending of the curved legs 212*a*, 214*a*. The curved legs 212*a*, 214*a* are pressed toward one another. The curved legs 212*a* are pressed toward the rotation axis 206*a*. The curved legs 212*a*, 214*a* are in each case over-pressed by an over-pressing distance 246*a*, 248*a*. The helix blank 210*a*, after being compressed, partially springs back, in particular by virtue of the high tensile strength of the wire 18*a*. In order for the geometry of the helix 12*a* described above to be implemented, the helix blank 210*a* has to be temporarily correspondingly pressed and/or compressed beyond this geometry, in particular in order for the mentioned spring-back of the helix blank 210*a* after the compressing to be equalized.

The straightening unit 222*a* is supported so as to be rotatable around the rotation axis 206*a*. The straightening unit 222*a* in the present case is rotated in an operation of the bending device 200*a*. The straightening unit 222*a* in the operation is rotated in the same direction as the braiding knife 208*a*. The pressing direction 224*a* conjointly rotates so as to correspond to the rotation of the straightening unit 222*a*.

The rotation of the braiding knife 208*a* and a rotation of the straightening unit 222*a* are synchronized. The straightening unit 222*a* in the present case is mechanically coupled to the braiding knife 208*a* so that the straightening unit 222*a* can be set in rotation conjointly with the braiding knife 208*a*. The rotation of the straightening unit 222*a* and a rotation of the helix blank 210*a* about the rotation axis 206*a* are synchronized. The straightening unit 222*a* in the operation is non-rotated relative to the braiding knife 208*a* and/or relative to the helix blank 210*a*. In the rotation of the straightening unit 222*a* around the rotation axis 206*a* the pressing direction 224*a* conjointly rotates in such a manner that the orientation of the latter relative to the helix blank 210*a* is constant or at least approximately constant. The pressing direction 224*a* is non-rotated relative to the helix blank 210*a*.

The straightening unit 222*a* has a pressing element 228*a* which is movable perpendicularly to the longitudinal direction 226*a* of the helix blank 210*a*. The pressing element 228*a* when compressing is moved in the pressing direction 224*a* toward the rotation axis 206*a* and/or toward the helix blank 210*a*. The pressing element 228*a* when compressing pushes against a curved leg to be straightened. The pressing element 228*a*, after the compressing, is moved counter to the pressing direction 224*a* away from the rotation axis 206*a* and/or from the helix blank 210*a*. A movement of the pressing element 228*a* in the pressing direction 224*a* and counter to the pressing direction 224*a* is coupled to the rotation of the straightening unit 222*a* and/or to the rotation of the braiding knife 208*a*. The pressing element 228*b* in the present case is dimensioned such that said pressing element 228*b* when compressing simultaneously straightens a plurality of legs, in the case shown three legs. Furthermore, the helix blank 210*a* and the further helix blank 236*a* are simultaneously straightened in the case shown. Of course, it is conceivable that only one helix blank is simultaneously bent and straightened. It is furthermore conceivable that a pressing element is differently dimensioned and, for example, when compressing simultaneously pushes only against one or two legs, or else against a larger number of legs, for example against four or five or six or ten or 20 or 30, or even more. A number of simultaneously pressed legs can in particular depend on a geometry of a helix blank, for example on a leg length and/or on a geometry of a bend point and/or on a first inclination angle and/or on a second inclination angle.

The pressing element 228*a* has a pressing surface 260*a* which is in a compression pushed against the helix blank 210*a*. The pressing surface 260*a* is illustrated as being straight in FIG. 8. It is also conceivable that a pressing surface is in particular implemented so as to be convexly curved and/or pre-bulged. A type of over-pressing and/or a type of over-bending can in particular be defined by a geometry of a pressing surface. For example, a pressing element can be configured for over-pressing and/or over-bending curved legs to a different degree at different points of the legs, for example to a higher degree in a central region of the legs.

The straightening unit 222*a* in the present case has a further pressing element 230*a*. The further pressing element 230*a* is embodied mirror-symmetrically to the pressing element 228*a*, in particular in relation to a symmetry plane in which the rotation axis 206*a* runs. The further pressing element 230*a* is embodied identically to the pressing element 228*a*. The further pressing element 230*a* is movable perpendicularly to the rotation axis 206*a*. A movement of the further pressing element 230*a* is coupled to a movement of the pressing element 228*a*. The pressing element 228*a* and the further pressing element 230*a* in the operation move in each case in opposite directions. The pressing element 228*a* and the further pressing element 230*a* in the compressing press the helix blank 210*a* from the opposite sides 242*a*, 244*a*.

The pressing element 228*a* is disposed in an outlet region 232*a* of the bending unit 202*a*. The pressing element 228*a* in the present case is disposed so as to be spaced apart from the braiding knife 208*a* by approximately 10 cm. In the production of the wire netting 10*a* the bent helix blank 210*a* exits the bending unit 202*a* and enters the straightening unit 222*a*. After the straightening of the curved legs 212*a*, 214*a*, the helix blank 210*a* runs into the braiding unit and therein is braided into the pre-netting 220*a*. The helix blank 210*a* is braided into the pre-netting 220*a* in a straightened state. The further pressing element 230*a* is disposed in the outlet region 232*a* of the bending unit 202*a*.

The bending unit 202*a* is configured for a processing of a wire having a tensile strength of at least 800 N $mm^{-2}$. The straightening unit 222*a* is configured for a processing of a wire having a tensile strength of at least 800 N $mm^{-2}$. The bending unit 202*a* and the straightening unit 222*a* in the present case are configured for a processing of the wire 18*a*.

Figure 9:
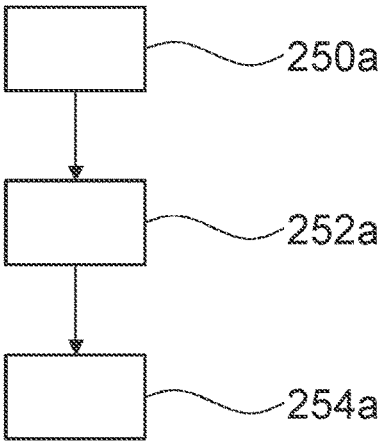
FIG. 9 shows a schematic flow diagram of a method for producing the wire netting.

FIG. 9 shows a schematic flow diagram of a method for producing the wire netting 10*a*. The wire netting 10*a* is produced by means of the bending device 200*a*.

In a first method step 250*a*, the helix blank 210*a* is made by a bending of the wire 18*a* by means of the bending device 200*a*. The helix blank 210*a* after the bending thereof has curved legs 212*a*, 214*a*.

The curved legs 212*a*, 214*a* are straightened in a second method step 252*a*. The second method step 252*a* is carried out after the first method step 250*a*.

The helix blank 210*a* is braided into the pre-netting 220*a* of the wire netting 10*a* in a third method step 254*a*. The third method step 254*a* is carried out after the second method step 252*a*.

The helix blank 210*a* before being braided into the pre-netting 220*a* is pressed at least section-wise for a straightening of the curved legs 212*a*, 214*a*. The curved legs 212*a*, 214*a* are over-bent and/or over-pressed for the straightening. The legs 212*a*, 214*a* in an over-pressed state are closer to a longitudinal axis 256*a* of the helix blank 210*a* than in the completed state in which the legs 212*a*, 214*a* have a geometry that corresponds to the geometry of the helix 12*a* of the wire netting 10*a*. The longitudinal axis 256*a* of the helix blanks 210*a* runs so as to be parallel to the longitudinal direction 226*a* of said helix blank 210*a*. In the production, the longitudinal axis 256*a* of the helix blank 210*a* corresponds to the rotation axis 206*a*. The longitudinal axis 256*a* of the helix blank 210*a* runs through a center of gravity of the helix blank 210*a*.

Figure 10:
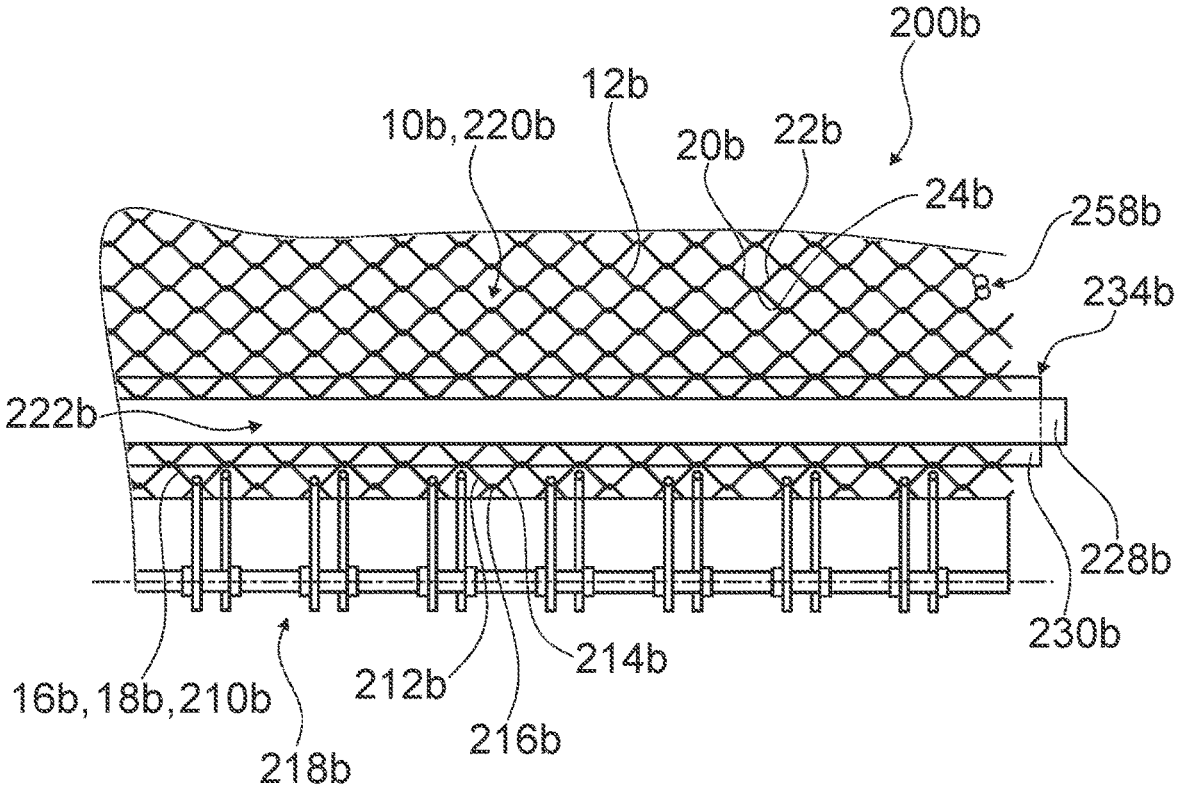
FIG. 10 shows a part of a further bending device in a schematic illustration.
Figure 11:
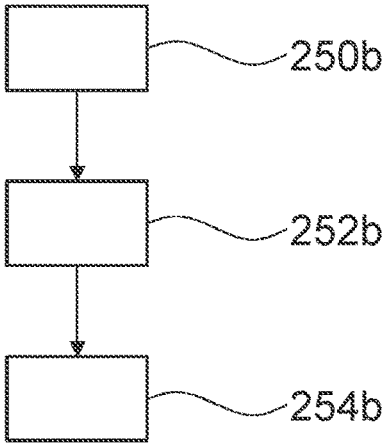
FIG. 11 shows a schematic flow diagram of a further method for producing a further wire netting.

A further exemplary embodiment of the invention is shown in FIGS. 10 and 11. The following descriptions and the drawings are restricted substantially to the differences between the exemplary embodiments, wherein, with regard to identically designated components, in particular with regard to components with the same reference signs, reference may basically also be made to the drawings and/or to the description of the other exemplary embodiment, in particular of FIGS. 1 to 9. To distinguish between the exemplary embodiments, the letter a has been added to the reference signs of the exemplary embodiment in FIGS. 1 to 9. In the exemplary embodiments of FIGS. 10 and 11, the letter a has been replaced by the letter b.

FIG. 10 shows a part of a further bending device 200*b* for producing a further wire netting 10*b* in a schematic illustration. The further wire netting 10*b* has a plurality of helices 12*b* which are braided with one another and which form square loops. The helices 12*b* have straight legs 20*b*, 22*b* which run in parallel planes. The legs 20*b* 22*b* are connected by way of bend points 24*b*, the profile of the latter describing a bend of 180°. The helices 12*b* at the ends 258*b* thereof are knotted in the completed further wire netting 10*b*. The further bending device 200*b* for knotting the helices 12*b* has a knotting unit (not shown).

The further bending device 200*b* has a bending unit (not shown) which, in a manner analogous to that of the bending unit 202*a* of the exemplary embodiment in FIGS. 1 to 9, is configured for producing a helix blank 210*b* having curved legs 212*b*, 214*b* from a longitudinal element 16*b* having at least one wire 18*b* that comprises steel. The longitudinal element 16*b* in the present case is realized, for example, as a wire strand from a plurality of twisted wires 18*b*. However, it is likewise conceivable that the longitudinal element 16*b* is embodied as a single wire or a wire bundle or the like. The curved legs 212*b*, 214*b* are connected by way of a bend point 216*b*. The bending device 200*b* has a braiding unit 218*b* which is configured for braiding the helix blank 210*b* into the pre-netting 220*b*.

The further bending device 200*b* has a straightening unit 222*b* which is configured for at least partially straightening the curved legs 212*b*, 214*b*. The straightening unit 222*b* is configured for straightening the curved legs 212*b*, 214*b*. The straightening unit 222*b* is configured for a bending of the helix blank 210*b* in such a manner that the geometry of the latter corresponds to a geometry of the helices 12*b* of the completed further wire netting 10*b*.

The straightening unit 222*b* is configured for compressing the helix blank 210*b*. The compressing includes over-pressing and/or over-bending of the curved legs 212*b*, 214*b*. The curved legs 212*b*, 214*b* in the compressing are compressed further than would correspond to a target geometry, so as to equalize a spring-back of the wire 18*b* after the compressing.

The straightening unit 222*b* has a pressing element 228*b* which is movable perpendicularly to the longitudinal direction 226*b* of the helix blank 210*b*. The pressing element 228*b* is disposed in a proximity 234*b* of the braiding unit 218*b*. The pressing element 228*b* defines a maximum length of the helix 12*b*. The pressing element 228*b* is configured for simultaneously straightening the helix blank 210*b* across the entire length thereof. A length of the pressing element 228*b* corresponds to a maximum length of a helix blank 210*b* which can be straightened by means of the straightening unit 222*b*.

The straightening unit 222*b* in the present case has a further pressing element 230*b*. The pressing element 228*b* and the further pressing element 230*b* are disposed in a mutually opposite manner. The pressing element 228*b* for the compressing is movable toward the further pressing element 230*b*. The pre-netting 220*b* is disposed between the pressing element 228*b* and the further pressing element 230*b*. The further pressing element 230*b* forms a counter-holding element which, when pressing the helix blank 210*b* by means of the pressing element 228*b*, supports the helix blank 210*b* from a side that is opposite the pressing element 228*b*. When advancing the pre-netting 220*b*, the latter is pushed through the straightening unit 222*b*. The pre-netting 220*b* in the advancing is pushed over the further pressing element 230*b*.

FIG. 11 shows a schematic flow diagram of a method for producing the further wire netting 10*b*. The further wire netting 10*b* is produced by means of the further bending device 200*b*.

In a first method step 250*b*, the helix blank 210*b* is made by a bending of the wire 18*b* by means of the bending device 200*b*. The helix blank 210*b* after the bending thereof has curved legs 212*b*, 214*b*.

In a second method step 252*b*, the helix blank 210*b* is braided into the pre-netting 220*b* of the wire netting 10*b*. The second method step 252*b* is carried out after the first method step 250*b*.

In a third method step 254*b*, the helix blank 210*b* is straightened. The helix blank 210*b* after being braided into the pre-netting 220*b* is pressed at least section-wise for a straightening of the curved legs 212*b*, 214*b*. In the present case, the entire helix blank 210*b* is simultaneously pressed. The helix blank 210*b* is straightened by means of the straightening unit 222*b* in the third method step 254*b*. The third method step 254*b* is carried out after the second method step 252*b*.

FIGS. 12 to 16 show alternative implementations of pressing elements 228*c*, 228*d*, 228*e*, 228*f*, 228*g*. The dimensions and geometries shown are to be understood as being purely exemplary. In particular, the alternative pressing elements 228*c*, 228*d*, 228*e*, 228*f*, 228*g* shown can be configured for pressing single or a plurality of legs, or else entire helix blanks, and have corresponding dimensions. In principle, it is furthermore conceivable that elements and/or features shown of the pressing elements 228*c*, 228*d*, 228*e*, 228*f*, 228*g* are present on the latter in multiples, or a pressing element has said elements and/or features in multiples, respectively, so as to optionally accomplish a simultaneous straightening of a desired number of legs. Moreover, pressing elements which have the features shown in multiples, in particular in combination, are of course conceivable.

Figure 12:
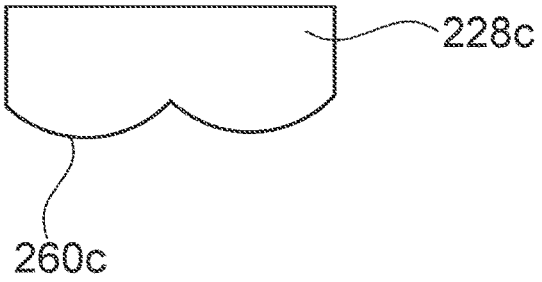
FIG. 12 shows a first alternative pressing element in a schematic illustration.

FIG. 12 shows a first alternative pressing element 228*c* in a schematic illustration. The first alternative pressing element 228*c* has a pressing surface 260*c* that is pre-bulged multiple times in a convex manner. The pressing surface 260*c* in the present case, which is to be understood to be purely exemplary, has two pre-bulged features. A number of pre-bulged features advantageously corresponds to a number of portions between bend points of a helix blank to be straightened in which legs of the helix blank can be straightened. The pre-bulged pressing surface 260*c* enables over-pressing of legs to be straightened.

Figure 13:
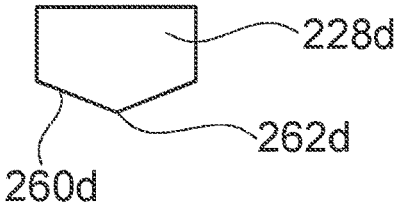
FIG. 13 shows a second alternative pressing element in a schematic illustration.

FIG. 13 shows a second alternative pressing element 228*d* in a schematic illustration. The second alternative pressing element 228*c* has a pressing surface 260*d* having a projecting tip 262*d*. The tip 262*d* enables over-pressing of legs to be straightened. The pressing surface 260*d* in the case shown has only one tip 262*d*. A number of tips 262*d* is of course adaptable to a requirement of a straightening. Other geometries, which in particular project at least section-wise and which are in particular different from pre-bulged features and/or tips, are in particular also conceivable.

Figure 14:
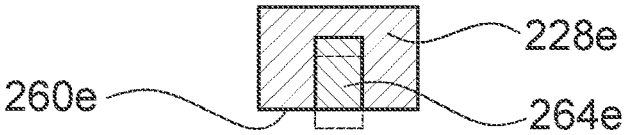
FIG. 14 shows a third alternative pressing element in a schematic sectional illustration.

FIG. 14 shows a third alternative pressing element 228*e* in a schematic sectional illustration. The pressing element 228*e* has a movable over-pressing element 264*e*. The over-pressing element 264*e* is supported so as to be deployable from a pressing surface 260*d* of the third alternative pressing element 228*e*. A movement of the over-pressing element 264*e* is advantageously adapted to and/or synchronized with a movement of the pressing element 228*e* and/or a manufacturing cycle and/or a helix advancement. When straightening a leg, the pressing surface 260*d* can be brought to bear on the leg and the latter can be straightened and in particular over-pressed by means of deploying the over-pressing element 264*e*. It is conceivable that an over-pressing distance is adaptable by means of open-loop and/or closed-loop controlling of the deployment of the over-pressing element 264*e*, for example adaptable to a geometry and/or material characteristic and/or flexural rigidity of a helix blank to be straightened.

The third alternative pressing element 228*e* advantageously has at least one corresponding over-pressing element 264*e* for each leg to be straightened. The over-pressing element 264*e* can in particular be adapted to a profile and/or a geometry of a helix blank and/or leg to be straightened, and/or be configured for guiding said helix blank and/or leg to be straightened.

Figure 15:
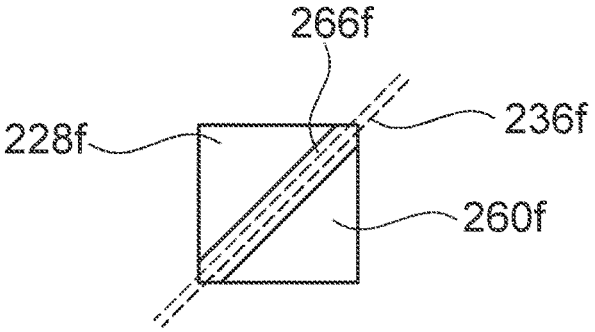
FIG. 15 shows a fourth alternative pressing element in a schematic illustration.

FIG. 15 shows a fourth alternative pressing element 228*f* in a schematic illustration. The fourth alternative pressing element 228*f* has a pressing surface 260*f* having a guide groove 266*f*. When straightening, a helix blank 236*f* to be straightened can be guided at least section-wise by the guide groove 266*f*. Any lateral slipping and/or evading by a helix blank to be straightened, in particular when over-pressing, can be advantageously prevented on account thereof.

Figure 16:
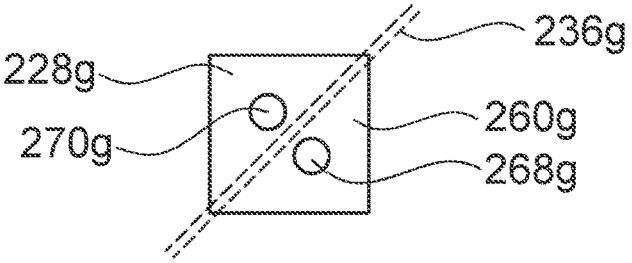
FIG. 16 shows a fifth alternative pressing element in a schematic illustration.

FIG. 16 shows a fifth alternative pressing element 228*g* in a schematic illustration. The fifth alternative pressing element 228*g* has a pressing surface 260*g*. The fifth alternative pressing element 228*g* furthermore has guide elements 268*g*, 270*g*. The guide elements 268*g*, 270*g* are embodied as bolts. When straightening, a helix blank 236*g* to be straightened can be guided at least section-wise by the guide elements 268*g*, 270*g*. Any lateral slipping and/or evading by a helix blank to be straightened, in particular when over-pressing, can be advantageously prevented on account thereof. The pressing element 228*g* in the present case, which is to be understood as being purely exemplary, has two guide elements 268*g*, 270*g*. However, it is conceivable that a pressing element has a larger number of guide elements, in particular in the case of a plurality of legs having to be simultaneously straightened and/or guided. It is furthermore conceivable for a leg to be guided by more than two guide elements.

LIST OF REFERENCE SIGNS

10 Wire netting
12 Helix
14 Helix
16 Longitudinal element
18 Wire
20 Leg
22 Leg
24 Bend point
26 Inclination angle
28 Longitudinal direction
30 Inclination angle
32 Bend point
44 Transverse extent
54 Frontal direction
109 Longitudinal axis
110 Longitudinal axis
112 Direction of main extent
114 Longitudinal axis
118 Intersection angle
200 Bending device
202 Bending unit
204 Guide worm
206 Rotation axis
208 Braiding knife
210 Helix blank
212 Leg
214 Leg
216 Bend point
218 Braiding unit
220 Pre-netting
222 Straightening unit
224 Pressing direction
226 Longitudinal direction
228 Pressing element
230 Pressing element
232 Outlet region
234 Proximity
236 Helix blank
238 Wire
240 Feed direction
242 Side
244 Side
246 Over-pressing distance
248 Over-pressing distance
250 Method step
252 Method step
254 Method step
256 Longitudinal axis
258 End
260 Pressing surface
262 Tip
264 Over-pressing element
266 Guide groove
268 Guide element
270 Guide element

The invention claimed is:

1. A bending device for producing a wire netting, the wire netting comprising a plurality of helices which are braided with one another and of which at least one helix is made from at least one longitudinal element having at least one wire that comprises high-tensile spring steel with a tensile strength of at least 800 N $mm^{-2}$, the bending device comprising:

at least one bending unit which is configured for processing the wire with the tensile strength of at least 800 N $mm^{-2}$, wherein the bending unit is configured to produce a helix blank having at least two curved legs and having at least one bend point that connects the curved legs by a bending of the longitudinal element, and has at least one guide worm and at least one braiding knife that is rotatable relative to the guide worm about a rotation axis, and a straightening unit which is configured for straightening of the curved legs, wherein the straightening unit has at least one pressing element which is movable perpendicularly to a longitudinal direction of the helix blank, wherein the straightening unit is configured for compressing the helix blank with the pressing element by an over-pressing of the curved legs in a pressing direction that is perpendicular to the rotation axis, and wherein the straightening unit is supported so as to be rotatable around the rotation axis.

2. The bending device as claimed in claim 1, wherein a rotation of the braiding knife and a rotation of the straightening unit are synchronized.

3. The bending device as claimed in claim 1, wherein the pressing element is disposed in an outlet region of the bending unit.

4. The bending device as claimed in claim 1, wherein the pressing element is configured for over-pressing and/or over-bending the curved legs to a different degree at different points of the legs.

5. The bending device as claimed in claim 4, wherein the pressing element is configured for over-pressing and/or over-bending the curved legs to a higher degree in a central region of the legs.

6. A method for producing a wire netting, the wire netting comprising a plurality of helices which are braided with one another and of which at least one helix is made from at least one longitudinal element having at least one wire that comprises high-tensile spring steel with a tensile strength of at least 800 N $mm^{-2}$, the method comprising:

making a helix blank having at least two curved legs and having at least one bend point that connects the legs by bending the at least one longitudinal element having the at least one high-tensile spring steel wire, straightening the curved legs of the helix blank using the bending device of claim 1 by an over-pressing in a pressing direction that is perpendicular to the rotation axis, wherein the legs that are to be straightened are over-pressed so far that upon completed bending and upon a subsequent partial spring-back the legs have a straight profile, providing a pre-netting, braiding the helix blank having the straight legs into the pre-netting, and after the braiding step, cutting off the helix blank having the straight legs so as to correspond to a width of the wire netting, wherein the helix blank having the straight legs, after being braided and after being cut forms the at least one helix of the plurality of helices that together form the wire netting.

7. A bending device for producing a wire netting, the wire netting comprising a plurality of helices which are braided with one another and of which at least one helix is made from at least one longitudinal element, having at least one wire that comprises high-tensile spring steel with a tensile strength of at least 800 N $mm^{-2}$, the bending device comprising:

at least one bending unit which is configured for processing the wire with the tensile strength of at least 800 N $mm^{-2}$, wherein the bending device is configured to produce a helix blank having at least two curved legs and having at least one bend point that connects the curved legs by a bending of the longitudinal element, and has at least one guide worm and at least one braiding knife that is rotatable relative to the guide worm about a rotation axis, and a straightening unit which is configured for a straightening of the curved legs, wherein the straightening unit has at least one pressing element, which is movable perpendicularly to a longitudinal direction of the helix blank, wherein the straightening unit is configured for compressing the helix blank with the pressing element by an over-pressing of the curved legs in a pressing direction that is perpendicular to the rotation axis, wherein a pressing surface of the pressing element is curved, and wherein the curved pressing surface is bulged in such a manner that different regions of a curved leg are bent and/or pressed, or are over-bent and/or over-pressed to a different extent.

8. The bending device as claimed in claim 7, wherein the curved pressing surface is bulged multiple times in a convex manner.

9. A method for producing a wire netting, the wire netting comprising a plurality of helices which are braided with one another and of which at least one helix is made from at least one longitudinal element having at least one wire that comprises high-tensile spring steel with a tensile strength of at least 800 N $mm^{-2}$, the method comprising:

making a helix blank having at least two curved legs and having at least one bend point that connects the legs by bending the at least one longitudinal element having the at least one high-tensile spring steel wire, straightening the curved legs of the helix blank using the bending device of claim 7 by an over-pressing in a pressing direction that is perpendicular to the rotation axis, wherein the legs that are to be straightened are over-pressed so far that upon completed bending and upon a subsequent partial spring-back the legs have a straight profile, providing a pre-netting, braiding the helix blank having the straight legs into the pre-netting, and after the braiding step, cutting off the helix blank having the straight legs so as to correspond to a width of the wire netting, wherein the helix blank having the straight legs, after being braided and after being cut off forms the at least one helix of the plurality of helices that together form the wire netting.

* * * * *